United States Patent [19]

Arai et al.

[11] Patent Number: 4,741,195

[45] Date of Patent: May 3, 1988

[54] APPARATUS FOR CLAMPING AND UNCLAMPING FEED BARS FOR A TRANSFER PRESS

[75] Inventors: Toshihiko Arai, Tsukui; Masaharu Kusunoki, Sagamihara; Tadao Odaka, Sagamihara; Shozo Imanishi, Sagamihara; Yoshinori Kato, Otsuki; Masakazu Hashimoto; Yoshiyuki Hashimoto, both of Sagamihara, all of Japan

[73] Assignee: Aida Engineering, Ltd., Sagamihara, Japan

[21] Appl. No.: 905,326

[22] Filed: Sep. 9, 1986

[30] Foreign Application Priority Data

Sep. 9, 1985 [JP] Japan ..... 60-137735[U]
Oct. 8, 1985 [JP] Japan ..... 60-154225[U]
Feb. 25, 1986 [JP] Japan ..... 61-26912[U]

[51] Int. Cl.[4] ..... B21D 43/10

[52] U.S. Cl. ..... 72/421; 72/405; 198/621; 74/834

[58] Field of Search ..... 72/421, 405, 422; 198/621, 774; 414/751; 74/834

[56] References Cited

U.S. PATENT DOCUMENTS 605,282 6/1898 Hinton ..... 74/834
3,411,636 11/1968 Wallis ..... 198/621
4,393,682 7/1983 Imanishi ..... 72/405
4,607,516 8/1986 Schafer et al. ..... 72/422
4,630,461 12/1986 Votava ..... 72/421
4,651,866 3/1987 Imanishi et al. ..... 198/621

*Primary Examiner*—Daniel C. Crane
*Attorney, Agent, or Firm*—Wenderoth, Lind & Ponack

[57] ABSTRACT

In a transfer press having feed bars and a press drive, an improved feed bar driving apparatus has a vertical rod reciprocally movable in association with the press drive and having a threaded portion, a drive means to the vertical rod means for rotating the vertical rod means in opposite directions, a feed screw device connected to the threaded portion of the vertical rod for being rotated by the vertical rod in opposite directions by rotation and reciprocation of the vertical rod, a pair of feed bar receptacles slidably supporting the feed bars and connected to the feed screw device for being moved toward and away from each other when the feed screw device is rotated in respective opposite directions for moving the feed bars in a clamping and unclamping movement, a cam rotatable in assocation with the press drive, a lever mounted on a fulcrum and connected to the vertical rod and in contact with the cam for being pivoted around the fulcrum by the cam for moving the vertical rod through a stroke, and a stroke adjusting mechanism connected to the fulcrum for changing the position of the fulcrum for selectively adjusting the stroke of the vertical rod and thereby adjusting the stroke of the feed bars.

13 Claims, 6 Drawing Sheets

APPARATUS FOR CLAMPING AND UNCLAMPING FEED BARS FOR A TRANSFER PRESS

DETAILED DESCRIPTION OF THE INVENTION

1. Field of Industrial Application

The present invention relates to a feed bar driving apparatus for a transfer press, and more particularly to an apparatus for clamping and unclamping the feed bars.

2. Prior Art

A device for clamping and unclamping the feed bars by means of a screw mechanism such as a ball thread, etc. is known as disclosed in the Japanese Utility Model Laid-Open No. 60-136828.

In the device as disclosed therein, a rod is adapted to reciprocate in association with a press slide and is connected via a ball joint to a screw rod consisting of a helical gear, and a ball thread is rotated in association with the screw rod and threadedly fitted with feed bar receptacles, whereby up-and-down movement of the rod causes the feed bar receptacles to move toward and away from each other and the feed bars to perform clamping and unclamping movement. The ball thread is formed with left-handed and right-handed threads so that the feed bar receptacles move in the opposite directions to each other when the screw rod rotates.

In the above-described device, the internal width between the feed bars is adjusted by rotating the screw rod and the ball thread, with the press the in non-operating condition.

Further, in the above-described device, a servomotor serving as a driving unit for the internal width adjustment is provided below a clamp cylinder and disposed in a hole formed at the lower end of the press machine. Thus, this device has a problem that a deep hole must be formed.

Still further, the above-described device has gears and motors mounted to vertically moving parts, resulting in excessive inertia acting upon a cam lever and is disadvantageous for high-speed stability. In addition, wiring becomes difficult because of mounting the motors to the moving parts.

There are two kinds of prior art apparatuses, one which cannot adjust the lengths of feed bar clamp and lift strokes while the other that can make such adjustment. Generally, the prior art apparatus includes a rod moving up and down in association with a cam provided on a slide, and a clamp unit having therein a feed bar driving apparatus, wherein the up-and-down movement of the rod causes the feed bars to perform clamping and unclamping as well as lifting and lowering movements in the clamp unit.

In the former type apparatus, the height of the rod-driving cam provided on the slide must be changed or the clamp drive mechanism must be changed, in order to change the feed bar clamp and/or lift stroke length. Actually, the apparatus cannot change its stroke length once it is manufactured. The latter type apparatus uses a mechanism for changing the fulcrum position of the lever, but with change in said position, the swing of both ends of the lever will be changed. Consequently, the internal width between the feed bars needs to be adjusted every time the clamp stroke is changed. Thus, there are problems that the adjusting operation becomes complicated when the transfer device is independently and manually operated and that programming also becomes complicated in case of automatic adjustment.

3. Objects of the Invention

It is one object of the present invention to solve the prior art problems and to provide an apparatus which can enlarge the range available for the feed bar internal width by using a ball thread as feed bar clamping mechanism and adjusting the internal width by means of a worm and rack mechanism.

It is another object of the present invention to provide an apparatus in which only the clamp stroke can be changed without changing the clamp end (the internal width of the feed bars) and also the lift stroke can be changed without changing the feed line of the feed bars.

The present invention is characterized in that feed bar receptacles for supporting feed bars are driven by a feed screw rod consisting of a ball thread and a screw rod connected via a ball joint to a rod receiprocating in association with press drive system, which screw rod is connected at one end thereof to a piston housed in a clamp cylinder and formed at one portion thereof as a spline engaged with a worm wheel that is provided in the clamp cylinder and engaged with a worm rod connected to a drive shaft of a motor on the side of the clamp cylinder, said feed screw rod being connected to said screw rod via a transmission mechanism so that it may be driven by reciprocation and rotation of said screw rod.

Furhter, the present invention comprises a lever having a cam follower at one end thereof and connected to the rod at the other end, said lever being formed with a longitudinal opening in the central portion thereof, a fulcrum member slidably housed in the opening of the lever, and a link having an axis of rotation at one end thereof with the other end facing the fulcrum member, said facing portion being connected with a pin provided at the center of the fulcrum member, said opening of the lever being formed in an arc corresponding to the locus of the pin when the link rotates with the lever at either limit of its swinging motion, said rod being connected at the lower end thereof to the clamp unit, and said cam follower of the lever being in contact with a cam rotated in association with a crankshaft, whereby the present apparatus can be selectively used when the clamp and/or lift stroke is adjusted.

DESCRIPTION OF THE DRAWINGS

FIG. 9 is a sectional view taken on line IX—IX of FIG. 8;

FIG. 10 is a view showing the engagement of gears which provide a device for reversing rotation;

FIG. 11 is a sectional view of another reversing device comprising helical gears.

EMBODIMENTS

Figure 1:
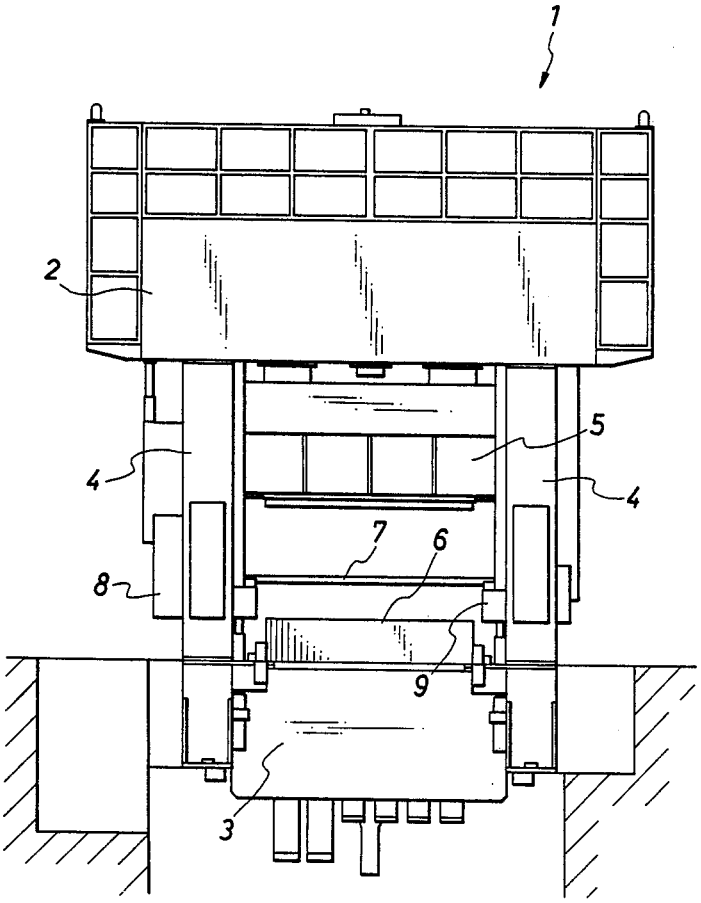
FIG. 1 is a schematic front view of a press.

FIG. 1 is a schematic front view of a press 1 having a crown 2 and a bed 3 joined together by columns 4, inside which a press slide 5 is provided and is lifted and lowered relative to a bolster 6 provided on the bed 3.

A pair of feed bars 7 are provided on both sides of plural dies, not shown, placed on the bolster 6, and the feed bars are connected at one side to a drive unit casing 8 from which they receive advancing and returning movement and at the other side to a drive unit casing 9 from which they receive clamping and unclamping and lifting and lowering movements.

Referring to FIGS. 2 to 5, the pair of feed bars 7 are respectively disposed on feed bar receptacles 10 so that they can slide in the longitudinal direction, and the feed bar receptacles 10 are respectively mounted on carriers 11. A guide 12 is provided perpendicularly to the longitudinal direction of the feed bars, and the carriages 11 are movably mounted on the guide 12 by means of rollers 13. The guide 12 is secured to the unit casing 9 and the feed bar receptacles 10 protrude upward therefrom.

A feed screw rod 14 comprising a ball thread parallel to the guide 12 (or perpendicular to the feed bars) is threadedly fitted with the carriages 11 and is mounted in the unit casing 9 with one end protruding therefrom. The feed screw rod 14 is provided with left-hand are right-hand screw portions, 14*a* and 14*b*, which are engaged with the carriages 11 respectively and are threaded in different directions from each other. With rotation of the feed screw rod 14, the carriages 11 with the feed bars 7 thereon move toward and away from each other, thereby causing the feed bars to perform clamping and unclamping movement.

Further, the carriages 11 are provided with a spline rod 15 parallel to the feed screw rod 14, and when this spline rod 15 rotates, the feed bar receptacles 10 move up and down, causing the feed bars to perform lifting and lowering movement.

Press machine wherein the feed bars perform only two-dimensional clamping and unclamping movement will not need the spline rod and attachments therefor which serve to lift and lower the feed bars.

The feed screw rod 14 and the spline rod 15 are respectively provided with helical or worm gears 30 and 31 at the respective ends protruding from the unit casing 9*a*. The worm gears 30 and 31 are respectively engaged with worms 30*a* and 31*a* of vertical threaded rods 32 and 33. The upper ends of the vertical threaded rods 32 and 33 are respectively connected via ball joints 34 and 35 to vertical rods 36 and 37. The vertical rods 36 and 37 are adapted to move up and down in association with the press drive system.

The lower ends of the vertical threaded rods 32 and 33 are respectively provided with clamp cylinders 38 and 39 which allow adjustment of the internal width between the feed bars. The internal construction of the clamp cylinders 38 and 39 is identical and therefore it will be described with reference to only one clamp cylinder.

The vertical threaded rod 32 is connected to a piston 40 housed in the clamp cylinder 38 and is formed with a spline 32*b* at a portion above said piston 40. The clamp cylinder 38 has therein a worm wheel 41 which is engaged with the spline 32*b*. The worm wheel 41 is also engaged with a worm rod 42 connected to a drive shaft of an adjustment motor 43 protruding from the clamp cylinder.

Figure 2A:
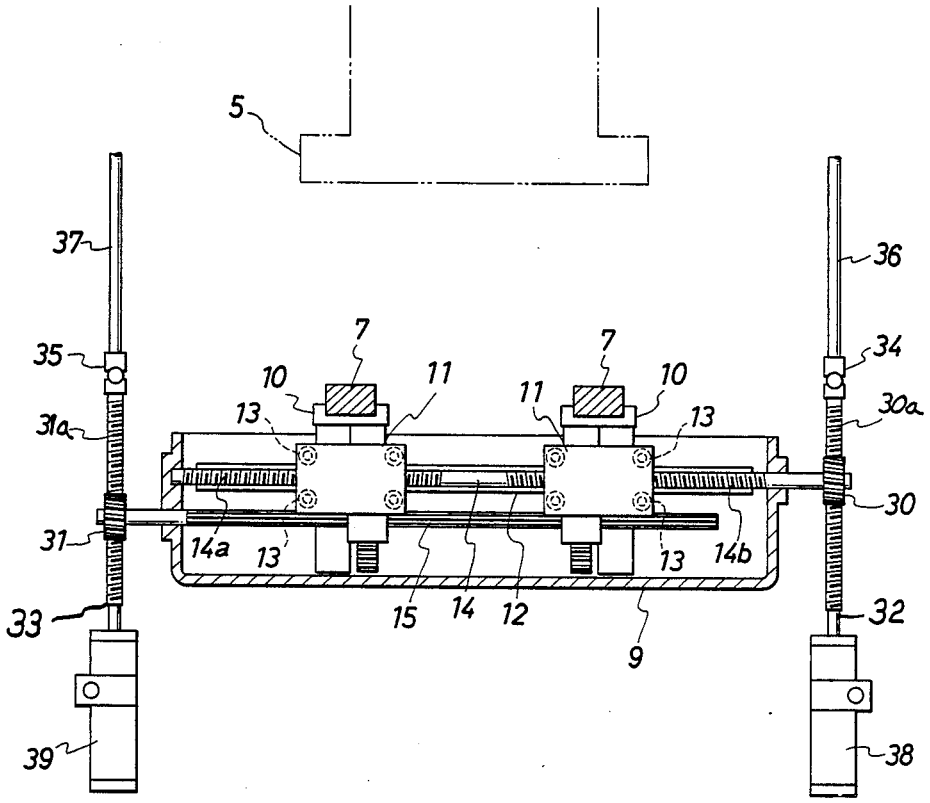
FIG. 2A is a side view of a feed bar clamping and unclamping mechanism and a stroke adjusting mechanism incorporated in the press.
Figure 2B:
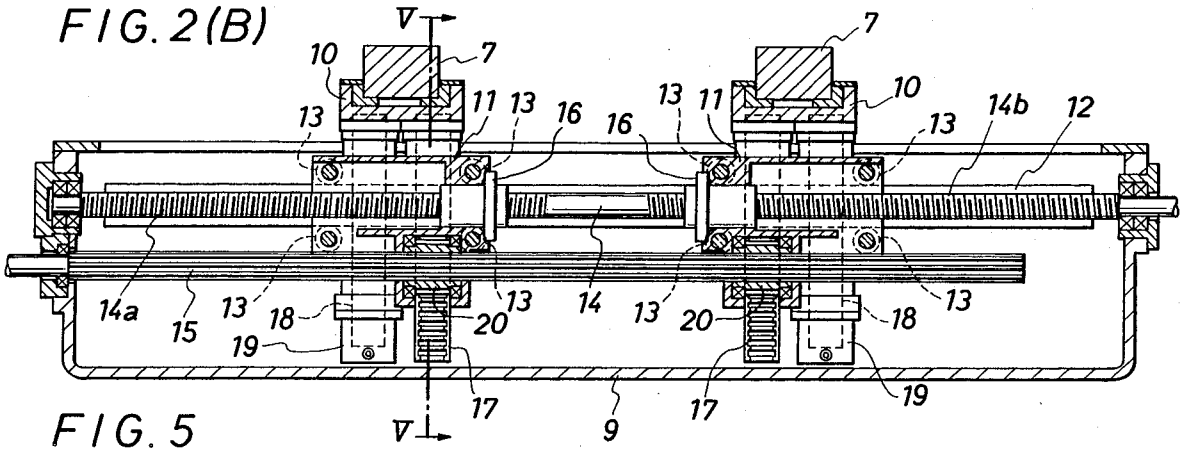
FIG. 2B is a detailed view thereof.
Figure 5:
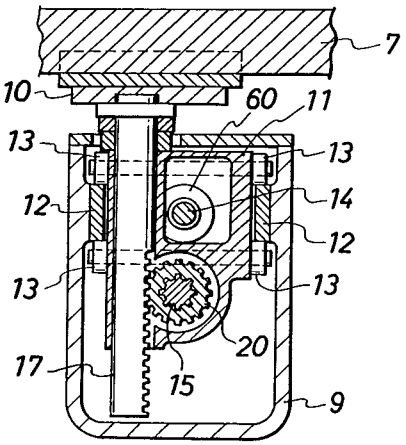
FIG. 5 is a sectional view taken on line V—V of FIG. 2B.

Referring particularly to FIG. 2B, the feed screw rod 14 is threadedly fitted with ball-filled nut members 16 and these nut members are united with and held by the carriages 11, respectively.

The feed bars 7 are respectively slidably supported by the feed bar receptacles 10, each united with vertically extending rack member 17 and plunger member 18, and these members 17 and 18 are inserted in the carriage 11 in a vertically slidable manner, respectively. Air is supplied to cylinders 19 of the carriages 11 where the plungers 18 are inserted, and this air pressure acts upon the plungers 18 so as to balance the weights of the feed bars 7 and the feed bar receptacles 10.

The spline rod 15 is inserted in and slidably engaged with pinions 20 rotatably mounted in the carriages 11. The pinions 20 are respectively engaged with the rack members 17, and these rack members 17 are constructed to move up and down when the pinions 20 move up and down, or in the opposite directions, through the rotation of the spline rod 15 in one or the other directions.

As the vertical rod 36 is moved up and down by the press operation, the feed screw rod 14 rotates together with the worm mechanism 30*a* and 30 actuated in association with oxial movement and rotation of the vertical rod 36. Thereby, the carriages 11 each equipped with the nut member 16 move in the opposite directions to each other and the feed bars 7 clamp and unclamp while being supported by the feed bar receptacles 10 each moving in the horizontal direction together with the carriage 11.

The vertical rod 37 for driving the spline rod 15 serves to cause the feed bars to perform three-dimensional movement, and therefore it is rotated only when such three-dimensional movement is desired. The rotation of the spline rod 15 causes the pinions 20 to rotate and the rack members 17 to move up and down, whereby the feed bar receptacles 10 move up and down and the feed bars 7 perform lifting and lowering movement.

Figure 7:
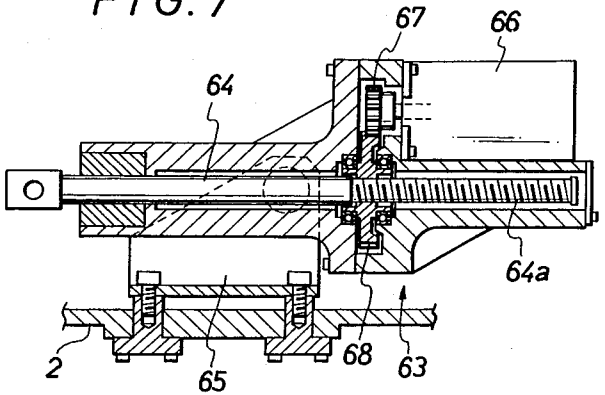
FIG. 7 is a sectional view of an adjustment unit.
Figure 3:
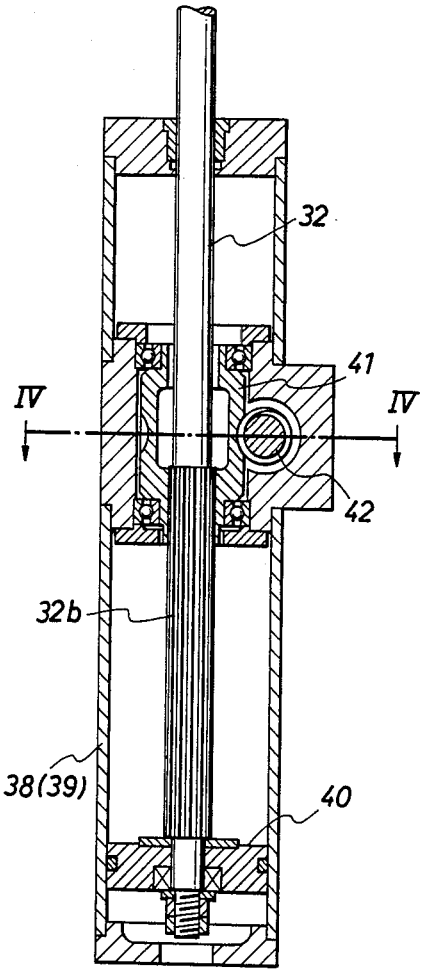
FIG. 3 is a sectional view of a clamp cylinder.
Figure 4:
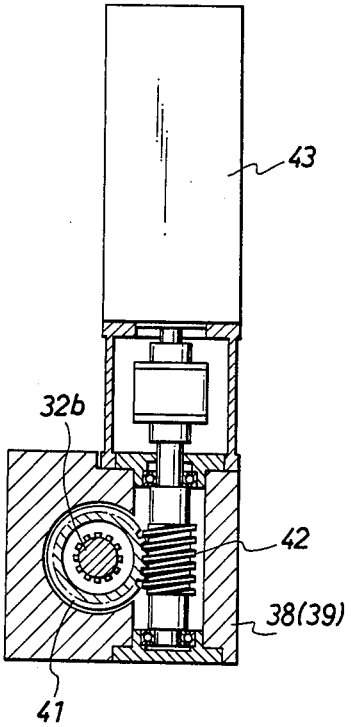
FIG. 4 is a sectional view taken on line IV—IV of FIG. 3.
Figure 6A:
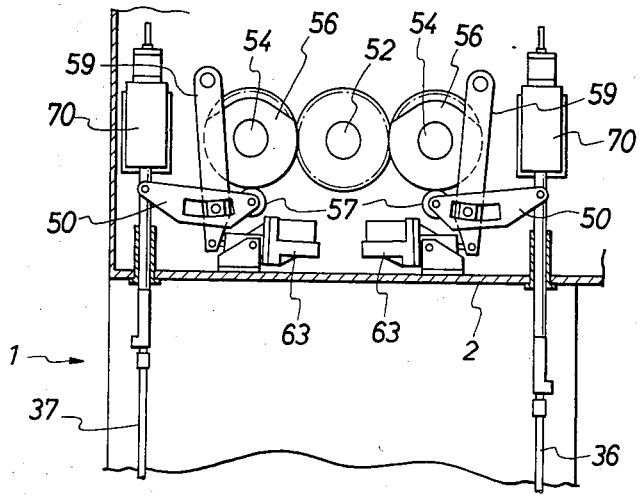
FIG. 6A is a side view of an adjusting mechanism of the feed bar clamp and lift strokes.
Figure 6B:
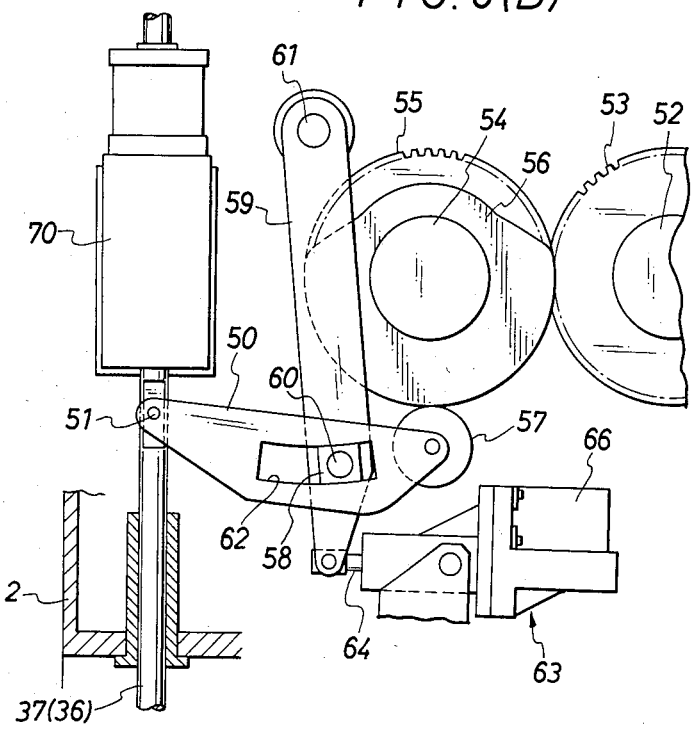
FIG. 6B is a detailed view thereof.

Next, adjustment of the feed bar clamp and lift strokes will be described with reference to FIGS. 6 and 7. If the press has fixed clamp and lift strokes, this adjustment mechanism will be unnecessary.

The upper ends of the vertical rods 36 and 37 for driving the feed screw rod and the spline rod reach the crown 2, and levers 50 and 50 are respectively mounted on shafts 51 in promixity of the upper ends of the vertical rods 36 and 37. A crankshaft 52 is mounted in the crown 2 and provided with gear 53, which is engaged with gears 55 on cam shafts 54. Each of the cam shafts 54 is provided with a cam 56 that is in contact with a cam follower 57 on said lever 50.

The right-hand cam 56 is for limiting the stroke for clamping and unclamping the feed bars and the left-hand cam 56 is for limiting the stroke for lifting and lowering them. As these cams have an identical stroke-adjusting mechanism, although different in shape, the adjusting mechanism as illustrated in detail with reference to only one cam.

Fulcrum members 58 are respectively provided in a mid portion of the levers 50 and connected to links 59 by pins 60. The links 59 are rotatably mounted on the crown by supporting shafts 61, respectively. The levers 50 are respectively formed with arcuate longitudinal openings 62 defined around the supporting shafts of the links 59. The levers 50 and the links 59 are connected together by the fulcrum members 58 slidable in the longitudinal openings 62, respectively. Further, the links 59 respectively have the lower end protruding from the levers 50 and are connected to adjusting rods 64 of adjusting units 63 at the free end thereof.

The adjusting unit 63 is secured to the crown 2 by means of a mounting member 65 and is provided with a motor 66 having a drive shaft. This drive shaft is provided with a pinion 67 and a drive gear 68 engaged therewith and prevented from axial movement. The end of the adjusting rod 64 is formed as a screw rod 64*a*, which is threadedly fitted with the drive gear 68.

When the pinion 67 is rotated by the drive from the motor 66, the pinion 67 rotates the drive gear 68 and then the adjusting rod 64 reciprocates in the axial direction, thereby causing the link 59 to swing about the supporting shaft 61 with the fulcrum member 58 sliding along the longitudinal opening 62.

The clamp cylinders 38 and 39 are respectively provided at the lower ends of the vertical rods 36 and 37, as shown in FIG. 2A, ensuring contact between the corresponding cam follower 57 and the cam 56. On the other hand, the upper ends of the vertical rods are respectively connected to adjustment cylinders 70 each for separating the cam 56 from the lever 50 and moving only the vertical rod up and down.

With rotation of the cams 56, the levers 50 respectively swing about the fulcrum members 58 together with the cam followers 57, moving the vertical rods 36 and 37 up and down, whereby the feed bars 7 perform both clamping and unclamping movement and lifting and lowering movement.

The feed bar lift and clamp strokes can be changed by changing the length of the up-and-down stroke of the vertical rods 36 and 37, which length is changeable by changing the positions of the fulcrum members 58 of the levers 50. In order to change the positions of the fulcrum members 58, the motors 66 of the adjusting units 63 are driven to reciprocate the adjusting rods 64 and rotate the links 59, respectively.

The longitudinal openings 62, each in the lever 50, correspond to the locuses of the pins when the links 59 rotate, respectively, so that there will be no change in the position which the end of the lever 50 at connection with the rod takes when the lever 50 is located at either limit of the swinging motion. Namely, the length of the feed bar stroke can be adjusted with a fixed lower end for lift stroke adjustment and with a fixed clamp end for clamp stroke adjustment.

FIGS. 8 to 11 show other embodiments of the feed bar clamping and unclamping apparatus.

In the casing 9 for the unit for clamping and unclamping the feed bars 7, there are provided two horizontal feed screw rods 100 and 101, the feed screw rod 101 protruding from the casing 9 and connected to a drive unit, not shown. The casing 9 has therein a spline rod 102 parallel to the feed screw rods 100 and 101, and this spline rod 102 is prodtruding from the casing 9 in the opposite direction to the feed screw rod 101 and connected to a drive unit, not shown.

Each of the feed screw rods 100 and 101 mounted in the unit casing 9 is a right-handed screw comprising a ball thread. The feed screw rods 100 and 101 are respectively threadedly fitted with ball-filled nut members 103, and these nut members are respectively united with and held by carriages 104. On the inner wall surface of the unit casing 9, are mounted guide rails 105 each extending in the axial direction of the feed screw rod (or perpendicularly to the longitudinal direction of the feed bars) and the carriages 104, each provided with rollers 106 in rotatable engagement with the guide rail 105, are adapted to move along on said guide rails.

The feed bars 7 are respectively supported by the feed bar receptacles 110 on the carriages 104 in a slidable manner. The carts 104 are respectively united with vertically extending rack members 107 and plunger members 108, and these members 107, 108 and are respectively inserted in the carriages 104 in a vertically slidable manner. Air is supplied to cylinders 109 of the carriages 104 where the plungers 108 are inserted, and this air pressure acts upon the plungers 108 so as to balance the weights of the feed bars 7 and 7 and the feed bar receptacles 110 and 110.

Figure 9:
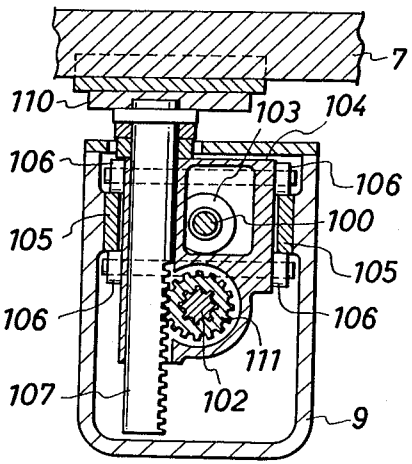

The spline rod 102 is inserted in and slidably engaged with pinions 111 rotatably mounted in the carriages 104. As shown in FIG. 9, the pinions 111 are respectively engaged with the rack members 107, and these members are constructed to move up and down when the pinions 111 rotate back and forward via the rotation of the spline rod 102 in opposite directions.

The two feed screw rods 100 and 101 are supported by the unit casing 9 and interconnected, on a support 112 provided at the center of the casing 9, by a reversing device 113 for reversing the rotational direction. This reversing device 113 transmits drive from the one feed screw rod 101 to the other 100 and at the same time reverses the rotation of the other feed screw rod.

Figure 10:
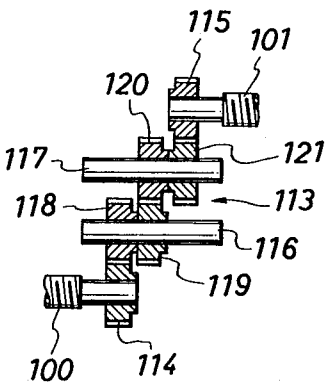

FIG. 10 is a view explaining the construction of the reversing device 113 comprising a group of gears. The feed screw rods 100 and 101 respectively have spur gears 114 and 115 at the end thereof. These spur gears 114 and 115 are interconnected by spur gears 118, 119, 120 and 121 provided on intermediate rods 114 and 115, whereby the rotation of the feed screw rod 101 is reversed and transmitted to the other feed screw rod 100.

When the feed screw rod 100 rotates in association with the press operation, the feed screw rods 100 and 101 with the reversing device therebetween rotate in the opposite directions. Thereby, the carriages 104 each with the nut member 103 move in the opposite directions and the feed bars 7 clamp and unclamp while respectively supported by the feed bar receptacle 110 moving integrally with the carriage 104 in the horizontal direction.

The spline rod 102 is used to cause the feed bars to perform three-dimensional movement, and therefore it may be rotated with the press when such movement is desired. With rotation of the spline rod 102, the pinions 111 rotate and the rack members 107 and the feed bar receptacles 110 move up and down, thereby lifting and lowering the feed bars 7.

Figure 11:
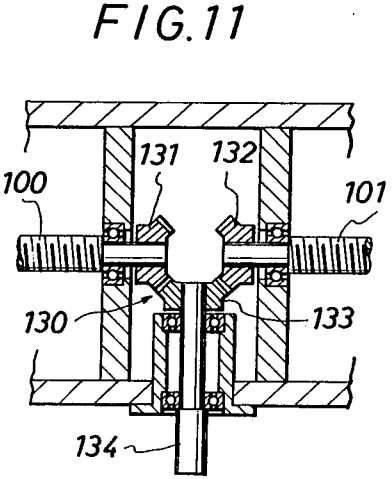

FIG. 11 shows another embodiment of the reversing device 130 for rotating the feed screw rods in the opposite direction to each other. The feed screw rods 100 and 101 are respectively provided at the face-to-face ends thereof with a first bevel gear 131 and a second bevel gear 132, and a third bevel gear 133 is interposed therebetween. The third bevel gear 133 is mounted at the end of a drive shaft 134 adapted to rotate in association with the press crankshaft. Accordingly, when the drive shaft 134 rotates and transmits its rotation through the third bevel gear 133 and then the first and second bevel gears 131 and 132 to the feed screw rods 100 and 101, these feed screw rods rotate in the opposite directions to each other in a similar manner to the FIG. 8 embodiment.

Figure 8:
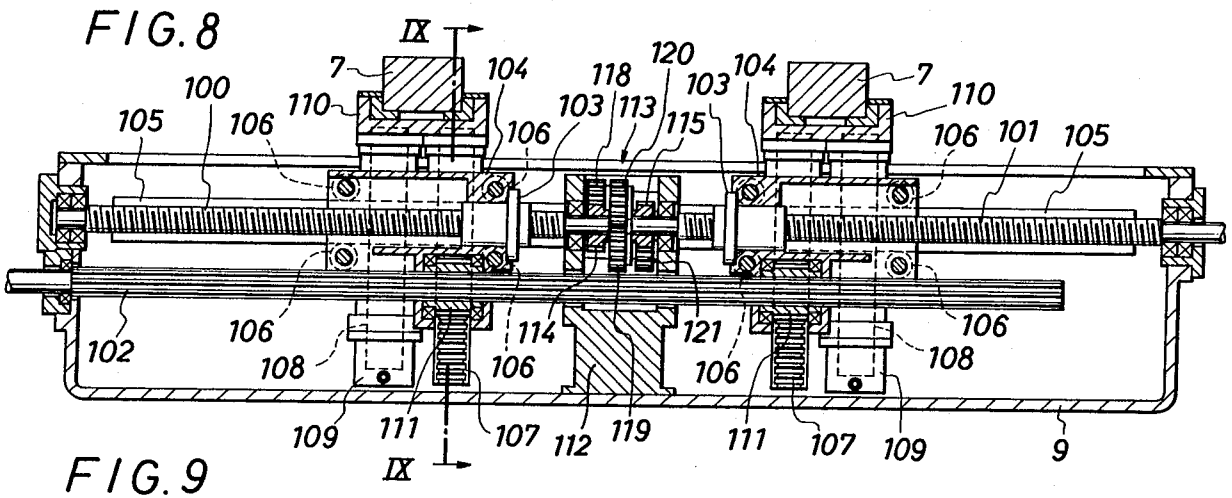
FIGS. 8 to 11 show other embodiments of the feed bar clamping and unclamping apparatus, FIG. 8 being a sectional view of one embodiment thereof.

It is to be noted that in the FIG. 11 embodiment the member 134 need not be a drive shaft but it may be just an intermediate rod, in which case the same effect is obtainable by transmitting drive to either of the feed screw rods in the same manner as in FIG. 8 embodiment. Further, it is also to be noted that the rotational reversal of the feed screw rods is attainable if either of the intermediate rods 116 and 117 is adapted to work as a drive shaft in the same manner as the FIG. 11 embodiment.

What is claimed is:

1. In a transfer press having feed bars and a press drive, an improved feed bar driving appartus comprising:

a vertical rod means reciprocally movable in association with the press drive and having a threaded portion;

a drive means connected to said vertical rod means for rotating said vertical rod means in opposite directions;

a feed screw means connected to the threaded portion of said vertical rod means for being rotated by said vertical rod means in opposite directions by rotation and reciprocation of said vertical rod means;

a pair of feed bar receptacles slidably supporting the feed bars and connected to the feed screw means for being moved toward and away from each other when said feed screw means is rotated in respective opposite directions for moving said feed bars in a clamping and unclamping movement;

a cam means rotatable in association with the press drive;

a lever mounted on a fulcrum means and connected to said vertical rod means and in contact with said cam means for being pivoted around said fulcrum by said cam means for moving said vertical rod means through a stroke; and a stroke adjusting mechanism connected to said fulcrum means for changing the position of said fulcrum means for selectively adjusting the stroke of said vertical rod means and thereby adjusting the stroke of said feed bars.

2. An improved driving apparatus as claimed in claim 1 wherein said feed screw means comprises a single rod having left and right handed threaded portions engaged with the respective feed bar receptacles for moving said feed bar receptacles toward and away from each other when said single rod is rotated in respective opposite directions by said vertical rod means.

3. An improved driving apparatus as claimed in claim 1 wherein said feed screw means comprises two rods each having threaded portions threaded in the same direction, and engaged with the respective feed bar receptacles, and a reversing device connected between said two rods for reversing the direction of rotation of one of the rods with respect to the other when the other is driven from said vertical rod means.

4. An improved driving apparatus as claimed in claim 3 wherein said reversing device comprises a plurality of spur gears.

5. An improved driving apparatus as claimed in claim 3 wherein said two rods having adjacent ends in spaced opposed relation, and said reversing device comprises a first and second bevel gears respectively mounted on the opposed ends of said two rods and a third bevel gear engaged between said first and second bevel gears.

6. An improved driving apparatus as claimed in claim 1 further comprising a unit casing, said feed screw means being mounted in said unit casing and having a portion thereof protruding from said unit casing, and a helical or worm gear being engaged with the threaded portion of said vertical rod means.

7. An improved driving apparatus as claimed in claim 1 wherein said feed screw means comprises a ball thread and said feed bar receptacles having nut members engaged with said ball thread.

8. An improved driving apparatus as claimed in claim 1 further comprising a clamp piston-cylinder means connected to the lower end of said vertical rod means for being urged up by said piston-cylinder means, the piston rod of said piston-cylinder means being splined, and a worm wheel slidably mounted on said splined piston rod, and a motor drive worm gear engage with said worm gear for rotating said splined piston rod and said vertical rod means.

9. An improved driving apparatus as claimed in claim 1 further comprising a link pivotally mounted on said press, said fulcrum means being a fulcrum at a mid-portion of said lever, said lever having an arcuate longitudingal opening therein with the center of curvature at the pivotal mounting of said link, and said fulcrum being slidable in said opening, said stroke adjusting mechanism being connected to the free end of said lever, whereby the position of said fulcrum can be changed by moving the free end of said lever.

10. An improved driving apparatus as claimed in claim 9 wherein said stroke adjusting mechanism comprises an adjusting rod, a motor having a drive shaft, said drive shaft having a pinion and a drive gear engaged with said pinion and fixed against axial movement, said adjusting rod having a threaded portion at one end thereof and having the other end connected to the free end of said link, said drive gear bring in threaded engagement with the threaded portion of said adjusting rod for axially moving said adjusting rod in response to the drive of said motor.

11. An improved driving apparatus as claimed in claim 1 further comprising a further vertical rod means reciprocally movable in association with the press drive and having a threaded portion, a further drive means connected to said Further vertical rod means for rotating said further vertical rod means in opposite directions, and a raising and lowering means connected to the threaded portion of said further vertical rod means and to said feed bar receptacles for raising and lowering said feed bar when said further vertical rod means is reciprocated and rotated in the respective opposite directions.

12. An improved driving apparatus as claimed in claim 11 wherein each of said feed bar receptacles has a vertically extending rack member and a plunger and an air cylinder in which said plunger is housed, and a pinion on said spline rod engaged with said rack for raising and lowering said rack.

13. An improved driving apparatus as claimed in claim 11 further comprising a further cam means rotatable in association with the press drive, a further lever mounted on a further fulcrum means and connected to said further vertical rod means and in contact with said further cam means for reciprocating said further vertical rod means, and a further stroke adjusting mechanism connected to said further fulcrum means for changing the position of said further fulcrum means for selectively adjusting the stroke of said further vertical rod means and thereby adjusting the up and down movement of said feed bars.

* * * * *